US010288033B2

(12) United States Patent
Toriyama et al.

(10) Patent No.: US 10,288,033 B2
(45) Date of Patent: May 14, 2019

(54) IGNITION APPARATUS FOR INTERNAL COMBUSTION ENGINE

(71) Applicant: DENSO CORPORATION, Kariya, Aichi-pref. (JP)

(72) Inventors: Makoto Toriyama, Kariya (JP); Satoru Nakayama, Kariya (JP)

(73) Assignee: DENSO CORPORATION, Kariya (JP)

( * ) Notice: Subject to any disclaimer, the term of this patent is extended or adjusted under 35 U.S.C. 154(b) by 200 days.

(21) Appl. No.: 15/302,543

(22) PCT Filed: Apr. 10, 2015

(86) PCT No.: PCT/JP2015/061232
§ 371 (c)(1),
(2) Date: Oct. 7, 2016

(87) PCT Pub. No.: WO2015/156391
PCT Pub. Date: Oct. 15, 2015

(65) Prior Publication Data

US 2017/0030319 A1 Feb. 2, 2017

(30) Foreign Application Priority Data

Apr. 10, 2014 (JP) ..... 2014-080941
Apr. 10, 2014 (JP) ..... 2014-080968

(51) Int. Cl.
*F02P 11/00* (2006.01)
*F02P 3/00* (2006.01)
(Continued)

(52) U.S. Cl.
CPC ..... *F02P 11/00* (2013.01); *F02P 3/00* (2013.01); *F02P 3/04* (2013.01); *F02P 3/045* (2013.01);
(Continued)

(58) Field of Classification Search
CPC ... F02P 3/04–3/558; F02P 11/00; F02P 11/06; F02P 9/002; F02P 15/10; F02P 15/12
(Continued)

(56) References Cited

U.S. PATENT DOCUMENTS 4,763,746 A * 8/1988 Ochiai ..... B60K 31/047 123/350
5,140,250 A * 8/1992 Morland ..... B60R 16/03 307/10.7
(Continued)

FOREIGN PATENT DOCUMENTS

DE 10 2011 006 268 A1 10/2012
JP 2000-154754 6/2000
JP 2011-085070 4/2011

*Primary Examiner* — Erick R Solis
*Assistant Examiner* — Robert A Werner
(74) *Attorney, Agent, or Firm* — Nixon & Vanderhye P.C.

(57) ABSTRACT

When an abnormality judgement section judges that there is a failure of an energy inputting circuit, an energy inputting line, through which electrical energy is inputted from the energy inputting circuit to a primary winding, is changed over to a disconnected state by output halt switching means. As a result, since inputting of electrical energy to the primary winding is thereby halted, problems arising due to continuation of inputting electrical energy to the energy inputting circuit can be prevented, even in the event of a failure of the energy inputting circuit, so that reliability can be enhanced.

8 Claims, 6 Drawing Sheets

(51) Int. Cl.

| | |
|---|---|
| ***F02P 3/04*** | (2006.01) |
| ***F02P 3/045*** | (2006.01) |
| ***F02P 9/00*** | (2006.01) |
| ***F02P 3/08*** | (2006.01) |
| *F02P 15/10* | (2006.01) |

(52) U.S. Cl.
CPC ..... *F02P 3/0892* (2013.01); *F02P 9/00* (2013.01); *F02P 15/10* (2013.01)

(58) Field of Classification Search
USPC ..... 123/594, 630, 632, 650, 620; 73/114.62
See application file for complete search history.

(56) References Cited

U.S. PATENT DOCUMENTS

| | | | | |
|---|---|---|---|---|
| 9,726,140 | B2 * | 8/2017 | Okuda ..... | F02P 11/06 |
| 2013/0335864 | A1 * | 12/2013 | Trecarichi ..... | F02P 3/051 361/36 |
| 2016/0061177 | A1 | 3/2016 | Ishitani et al. | |

* cited by examiner

IGNITION APPARATUS FOR INTERNAL COMBUSTION ENGINE

This application is based the U.S. national phase of International No. PCT/JP2015/061232 filed Apr. 10, 2015 which designated the U.S. and claims priority to Japanese Patent Application Nos. 2014-080941 and 2014-080968 both filed Apr. 10, 2014, the entire contents of each of which are hereby incorporated by reference.

FIELD

The present invention relates to an ignition apparatus for an internal combustion engine, and in particular to spark discharge continuation technology.

BACKGROUND

Technology is known which can be used for adding, to a usual ignition apparatus (main ignition apparatus), an apparatus for continuing an electric discharge after the electric discharge has been initiated by the main ignition apparatus. The continuation is achieved by inputting electric discharge energy into the ignition coil after the discharge has been initiated. It is intended to attain stable ignition in that way, by extending the continuation time of the discharge after commencement.

CITATION LIST

Patent Literature

[PTL 1]
PTL 1: JP-A-2011-85070

SUMMARY

A new type of ignition apparatus has been envisaged (not publicly known), as technology for reducing the load on spark plugs while reducing excess energy consumption, by continuation of a spark discharge.

For ease of understanding, the general configuration of a novel ignition apparatus will be described based on FIG. 9A. The designations used in FIG. 9 are identical to those used with embodiments described hereinafter, in referring to the same functional items.

The ignition apparatus A employs a novel energy inputting circuit 6 to continue spark discharge, during a spark discharge (referred to as the main ignition) that is generated by a known type of ignition circuit (referred to as the main ignition circuit).

The energy inputting circuit 6 is an "energy supply section" which inputs electrical energy from the negative end of the primary winding 3 to the battery voltage supply line a, to thereby continue the secondary current that flows in the secondary winding and so continue the spark discharge that is generated by the main ignition. The spark discharge is continued for an arbitrary interval (referred to in the following as the electric discharge continuation interval).

During the electric discharge continuation interval, the energy inputting circuit 6 controls the energy that is inputted into the primary winding 3, to thereby control the secondary current for maintaining the spark discharge. As a result of this technology, the spark discharge can be continued, while reducing a load imposed on the spark plug due to the spark discharge being extinguished and re-established, and wasteful energy consumption can be reduced.

In the following, the spark discharge that is continued by means of the energy inputting circuit 6 (i.e., the spark discharge that follows the main ignition) is referred to as the continuation spark discharge.

(Problems)

However, the following problems have been found by the inventors of the present invention.

The battery voltage supply line a includes a master power source line $\alpha$1 which supplies electric power from the vehicle-installed battery 7 to a plurality of apparatuses (ignition apparatus A, engine control apparatus B, fuel injection apparatus C, etc.), and also an ignition power source line $\alpha$2 which branches from the master power source line $\alpha$1 to supply electric power to the ignition apparatus A.

The master power source line $\alpha$1 is provided with an electric power relay 24 which is linked to a manually operated ignition switch 23. Switch-on of the ignition switch 23 causes electric power to be supplied from the vehicle-installed battery 7 to the plurality of apparatuses (ignition apparatus A, engine control apparatus B, fuel injection apparatus C, etc.) (e.g., see PTL1).

Let us discuss the case where unexpected problems may arise with the energy inputting circuit 6. Specifically, let us discuss the case where, when there is a failure of the energy inputting circuit 6, followed by the ignition switch 23 being set to the off state, the inputting of electrical energy from the negative end of the primary winding 3 to the master power source line $\alpha$1 is continued as shown by the arrows X and Y in FIG. 9(*b*).

In that case, there is a possibility that electrical energy, having been voltage stepped-up by the energy inputting circuit 6 (stepped-up to a higher voltage than that of the battery), will continue to be supplied to the master power source line $\alpha$1. If that occurs, there is a danger that the effects of continuing to supply electrical energy (excessive voltage/excessive current) to the master power source line $\alpha$1 from the energy inputting circuit 6 will continue to impinge on other equipment (the engine control apparatus B, the fuel injection apparatus C, etc.). There is a danger that this may result in failures of such other equipment, and also it may become impossible to halt the engine during the period in which the electrical energy continues to be inputted from the energy inputting circuit 6 to the primary winding 3.

It could be envisaged that, to overcome this problem, an abnormality judgement section 28 could be provided for judging occurrence of failure of the energy inputting circuit 6. When the abnormality judgement section 28 judges that there is a failure of the energy inputting circuit 6, the supplying of electrical power to the ignition apparatus A would be halted.

However, when the supplying of electric power to the ignition apparatus A is interrupted, the problem arises that, due to the halting of operation of the ignition apparatus A, the engine cannot be run.

In view of the above problem, it is an objective of the present invention to provide an ignition apparatus for an internal combustion engine whereby, even in the event of failure of the electrical energy inputting circuit, it can be ensured that electrical energy from the electrical energy inputting circuit is prevented from affecting other apparatuses by passing via the battery voltage supply line.

It is a second objective of the present invention to provide an ignition apparatus for an internal combustion engine whereby, even in the event of failure of the electrical energy inputting circuit, the engine can continue to run.

With an ignition apparatus for an internal combustion engine according to a first aspect of the present invention, the ignition apparatus is configured such that an energy input line from an energy inputting circuit to a main ignition circuit, or an energy input power source line to the energy inputting circuit, can be opened, halting the inputting of energy from the energy inputting circuit to the primary winding.

In that way, even in the event of failure of the energy inputting circuit, since the inputting of electrical energy into the primary winding is halted, problems caused by continuing to input energy into the primary winding can be avoided (such as the danger of failure of other apparatuses, and the danger that it may become impossible to halt the engine).

DESCRIPTION OF THE EMBODIMENTS

Figure 1:
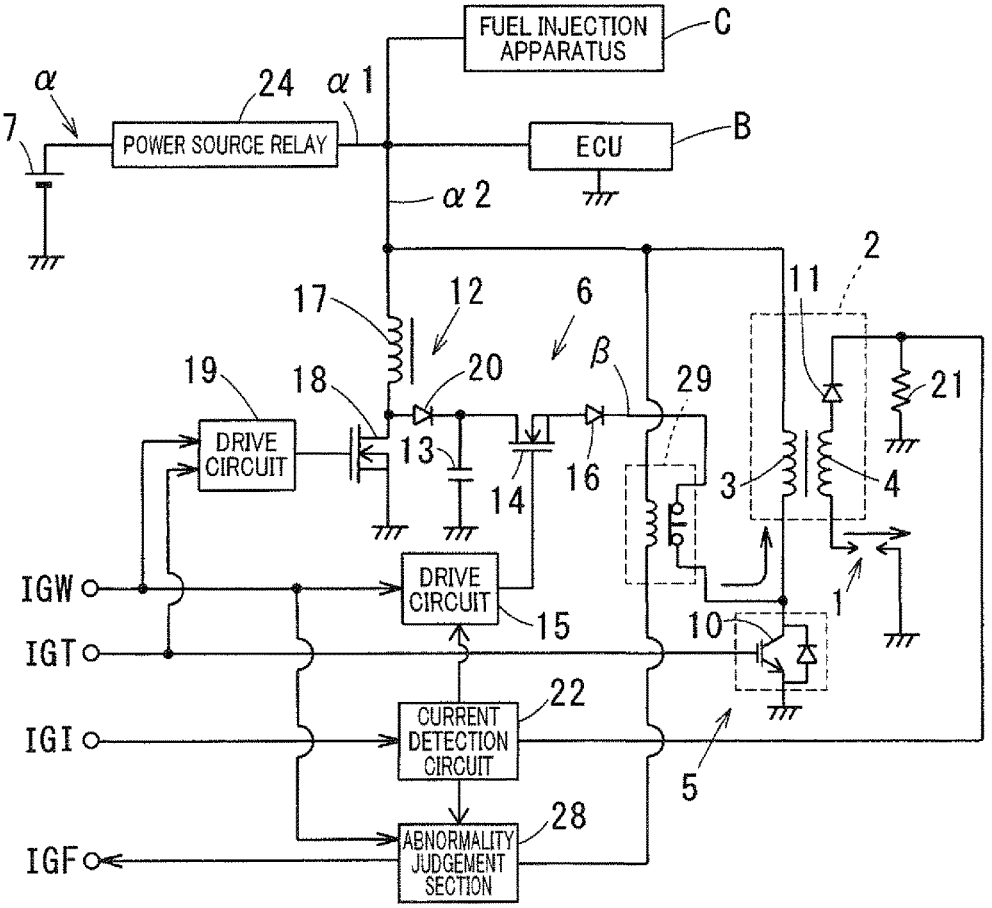
FIG. 1 is a general configuration diagram of an ignition apparatus for an internal combustion engine (first embodiment).

Embodiments for carrying out the invention are described in the following.

[Embodiments]

Specific embodiments will be described based on the drawings. These embodiments demonstrate specific examples, however the invention is of course not limited to the embodiments.

[First Embodiment]

A first embodiment will be described referring to FIG. 1.

An ignition apparatus A according to a first embodiment is used for a spark ignition engine for running a vehicle, and ignites an air/fuel mixture at predetermined ignition timings (ignition periods) within a combustion chamber. The engine as an example is a direct injection type of engine which is capable of lean-burn combustion operation and which uses gasoline as fuel. The engine incorporates an EGR (exhaust gas regeneration) apparatus which returns a part of the exhaust gas, as EGR gas, to the engine air intake. The engine also includes rotational flow control means which causes rotational flow (tumble flow, swirl flow, etc.) of the air/fuel mixture within each cylinder.

The ignition apparatus A of the first embodiment is a DI (abbreviation for "direct-ignition") type which uses ignition coils 2 corresponding to spark plugs 1 of the respective cylinders.

With this ignition apparatus A, conduction control of a primary winding 3 of an ignition coil 2 is performed based on command signals (an ignition signal IGT and a discharge continuation signal IGW) which are produced from an engine control apparatus (generally known as an ECU) B, on which engine control is centered. The ignition apparatus A performs control of the electrical energy produced in a secondary winding 4 of the ignition coil 2, by means of conduction control of the primary winding 3, thereby controlling the spark discharge of the spark plug 1.

An engine control apparatus B generates and outputs the ignition signal IGT and the discharge continuation signal IGW in accordance with engine parameters (warm-up condition, engine rotation speed, engine load, etc.) which are acquired from various sensors, and in accordance with the engine control status (i.e., whether lean-burn combustion operation is being applied, degree of rotational flow, etc.).

The ignition apparatus A installed in the vehicle includes:

spark plugs 1 installed in respective cylinders;

ignition coils 2 installed in respective spark plugs 1;

a main ignition circuit 5 which performs full transistor operation (full transistor ignition); and an energy inputting circuit 6 which performs spark discharge continuation.

The main parts of the main ignition circuit 5 and the energy inputting circuit 6 are contained together within a case, as the "ignition circuit unit", which is located separately from the spark plugs 1 and the ignition coils 2.

The spark plugs 1 are of known type, each having a central electrode which is connected to one end of the secondary winding 4, and an outer electrode which is connected to ground via the engine cylinder head, etc. Each spark plug 1 generates a spark discharge between the central electrode and the outer electrode by means of a high voltage applied from the secondary winding 4.

The ignition coil 2 is of well-known type, having the primary winding 3 and the secondary winding 4, with the secondary winding 4 having many more winding turns than the primary winding 3.

One end of the primary winding 3 is connected to a battery voltage supply line a, which receives electric power from the positive terminal of a vehicle-installed battery 7.

The other end of the primary winding 3 is connected to ground via an ignition switching means 10 (e.g., a power transistor, MOS type transistor, thyristor, etc.) of the main ignition circuit 5.

One end of the secondary winding 4 is connected to the central electrode of the spark plug 1 as described above.

The other end of the secondary winding 4 is connected to ground, or is connected to the battery voltage supply line a. In the drawing, the other end of the secondary winding 4 is connected to a first diode 11 which suppresses unnecessary secondary voltages that are produced when current is passed through the primary winding 3, and is connected to ground via the first diode 11 and a current detection resistor 21 which will be described hereinafter.

The main ignition circuit 5 generates the main ignition in the spark plug 1 by control of current passing through the primary winding 3. Specifically, the main ignition circuit 5 serves to set the ignition switching means 10 in the on state during an interval in which the ignition signal IGT is on.

When the ignition switching means 10 is turned on, current is passed through the primary winding 3 of the ignition coil 2.

The energy inputting circuit 6 inputs electrical energy from the negative terminal of the primary winding 3 to the battery voltage supply line a, following the main ignition that is produced by the operation of the main ignition circuit 5. The energy inputting circuit 6 thereby continues the passing of secondary current through the secondary winding 4 and continues the spark discharge produced by the operation of the main ignition circuit 5.

Specifically, during a driving condition in which the ignitability is low (during lean-combustion operation, or while strong rotational air currents are produced, or when a high EGR is utilized, or when the engine is being started in a low-temperature condition, etc.), the energy inputting circuit 6 continues spark discharge to thereby increase the ignitability of the air/fuel mixture. The energy inputting circuit 6 includes:

a step-up circuit 12 which steps up the battery voltage;

an energy input capacitor 13 which stores the electrical energy that has been stepped-up in voltage by the step-up circuit 12;

energy input switching means 14 (e.g., a MOS type of transistor, a power transistor, etc.) which turns on/off the energy inputting line β, through which electrical energy is inputted into the primary winding 3 from the energy input capacitor 13;

an energy input drive circuit 15 which performs on/off control of the energy input switching means 14; and a second diode 16 which passes current from the energy input capacitor 13 to only the primary winding 3.

The step-up circuit 12 is a DC-DC converter which performs DC voltage step-up, and which includes:

a choke coil 17 having one end connected to the battery voltage supply line a, step-up switching means 18 which connects and disconnects current path of the choke coil 17 (e.g., a field effect transistor, a power transistor, etc.), a step-up drive circuit 19 which repeatedly turns on/off the step-up switching means 18, and a third diode 20 which prevents electrical energy stored in the energy input capacitor 13 from flowing back towards the choke coil 17.

The step-up drive circuit 19 is provided to cyclically turn on/off the step-up switching means 18, during an interval when the ignition signal IGT supplied from the ignition signal generating section.

The energy input drive circuit 15 controls the on/off state of the energy input switching means 14 and, by control of the electrical energy inputted into the primary winding 3, maintains the secondary current to be within a predetermined target range during an interval in which the discharge continuation signal is supplied.

The energy input drive circuit 15 is a combination of a drive circuit and a control circuit. Specifically, a current detection circuit 22 monitors the secondary current by using the resistor 21, and the energy input drive circuit 15 performs feedback control of the on/off state of the energy input switching means 14 such as to maintain the secondary current, which is monitored by the current detection circuit 22, within the predetermined target range. The control that is executed by the energy input drive circuit 15 is not necessarily limited to feedback control, and it would be equally possible to execute on/off control of the energy input switching means 14 by open-loop control, such as to maintain the secondary current within the target range. Furthermore, it would be equally possible for the target value of the secondary current during the interval of the continuation spark discharge to be made constant, or to be varied in accordance with the engine running conditions (command signals that are not shown in the drawings, provided from the engine control apparatus B).

(Operation Description of the Ignition Apparatus A)

When the ignition signal IGT is changed over from the off to on state, then:

(a) during the interval in which the ignition signal IGT is outputted, the ignition switching means 10 is set to the on state, while concurrently.

(b) during the interval in which the ignition signal IGT is outputted, the step-up switching means 18 is repeatedly turned on/off to perform voltage step-up operation, thereby storing electrical energy in the energy input capacitor 13 at a voltage which is higher than the battery voltage.

(c) When the ignition signal IGT changes from the on to off state, the ignition switching means 10 is turned off, so that the current passing condition of the primary winding 3 is suddenly interrupted. As a result, the flow of primary current is suddenly halted, and concurrently the primary voltage rises. When the secondary voltage thereby rises, thus applying a high voltage to the spark plug 1, the main ignition is produced in the spark plug 1.

(d) After the commencement of main ignition in the spark plug 1, the secondary current attenuates with an approximately triangular waveform. Before the secondary current falls below a predetermined lower limit current (a current that enables the spark discharge to be maintained), the engine control apparatus B outputs the discharge continuation signal IGW.

In response, the energy input drive circuit 15 on/off-controls the energy input switching means 14, so that the charge (electrical energy) stored in the energy input capacitor 13 is inputted to the negative end of the primary winding 3. The electrical energy stored in the energy input capacitor 13, at a higher voltage than the battery voltage, thereby flows from the negative end of the primary winding 3 to the battery voltage supply line a.

Specifically, each time the energy input switching means 14 is turned on, electrical energy is supplementarily supplied from the negative end of the primary winding 3 to the battery voltage supply line a. Each time this occurs, a secondary current supplementarily flows in the secondary winding 4, passing in the same direction as the secondary current. As a result, such flows of secondary current through the secondary winding 4 occur successively, following the main ignition.

Thus, by performing on/off control of the energy input switching means 14, the energy input drive circuit 15 maintains the secondary current to an extent which enables the spark discharge to be continued.

This will be described more specifically. When the spark discharge is caused to waver by strong air currents or the like within the cylinder of the engine, the length of the spark discharge becomes increased and the discharge voltage becomes higher, while the secondary current becomes decreased. When the secondary current falls below a specific value, the energy input switching means 14 is turned on by feedback control of the secondary current, and electrical energy is again inputted to the primary winding 3. As a result, even if the spark discharge is caused to waver due to air currents to increase its length, the secondary current is held substantially constant, the discharge maintaining voltage can be maintained, and extinguishing of the spark discharge is prevented.

Conversely, if the secondary current tends to increase during the continuation spark discharge, the energy input switching means 14 is turned off by the feedback control of the secondary current, and the amount of electrical energy inputted to the primary winding 3 is thereby reduced. The secondary current is thus held substantially constant.

In that way, by maintaining a continuation spark discharge by the spark plug 1 during the interval for which the discharge continuation signal IGW is continued, a high degree of ignitability can be achieved, and an effect of reducing electrode wear is exerted in the spark plug 1. In addition, by optimally controlling the electrical power for maintaining discharge, wasteful power consumption can be prevented.

(f) When the discharge continuation signal IGW is changed from the on to the off state, operation of the energy input drive circuit 15 becomes halted and the energy input switching means 14 is changed to the off state. As a result, operation of the energy inputting circuit 6 becomes halted, and the continuation spark discharge is terminated.

(Special Technology of the First Embodiment)

The battery voltage supply line a, which is connected to the positive electrode of the vehicle-installed battery 7, is provided with a master power source line α1 and an ignition power source line α2. The master power source line α1 supplies the battery voltage to the ignition apparatus A, the engine control apparatus B and the fuel injection apparatus C, etc. The ignition power source line α2 branches from the master power source line α1, and supplies electric power to the ignition apparatus A. The positive end of the primary winding 3 is connected to the master power source line α1 via the ignition power source line α2.

The ignition apparatus A of the first embodiment is provided with the output halt switching means 29 (corresponding to the first switch) which executes changeover of the energy inputting line β between the connected and disconnected states, where the energy inputting line β performs inputting of electrical energy from the energy inputting circuit 6 to the primary winding 3. The ignition apparatus A is also provided with an abnormality judgement section 28 which changes over the output halt switching means 29 to a disconnected state when the energy inputting circuit 6 is determined to have a failure.

The output halt switching means 29 constitutes switching means (e.g., relay, MOS-type transistor, power transistor, etc.) which opens/closes the energy inputting line β that is between the energy input switching means 14 and the primary winding 3. In the example of the diagram, a relay (relay switch+relay coil) is used as the output halt switching means 29.

The abnormality judgement section 28 could be provided as a control program which is part of the engine control apparatus B. However, in the first embodiment, the abnormality judgement section 28 is provided to the "ignition circuit unit" that is independent of the engine control apparatus B. Although not limited to this, a specific example of failure judgement technology of the energy inputting circuit 6 is described in the following by way of a specific example, for ease of understanding.

The abnormality judgement section 28 is configured to receive, as inputs, the monitored value of the secondary current from the current detection circuit 22 and a command value from the energy input drive circuit 15. When a command for increasing the amount of electrical energy that is to be inputted to the energy input drive circuit 15 (i.e., a command for turning on the energy input switching means 14) is supplied continuously from the current detection circuit 22, but the monitored value of the secondary current does not react accordingly, then the abnormality judgement section 28 judges that there is an abnormality of the energy inputting circuit 6.

It is so configured that, when it is judged that there is a failure of the energy inputting circuit 6, the abnormality judgement section 28 changes over the output halt switching means 29 to the off state, immediately halting the inputting of energy to the primary winding 3 from the energy inputting circuit 6, while also outputting the failure detection signal IGF to the engine control apparatus B.

The designation IGI in FIG. 1 signifies the command signal that is supplied to the current detection circuit 22.

(Advantageous Effects of the First Embodiment)

As described above, with the ignition apparatus A of the first embodiment, when the abnormality judgement section 28 judges that there is a failure of the energy inputting circuit 6, the output halt switching means 29 is changed to the off state and the inputting of energy from the energy inputting circuit 6 to the primary winding 3 becomes immediately halted.

As a result, even in the event of failure of the energy inputting circuit 6, since the inputting of energy to the primary winding is halted, it becomes possible to prevent the danger of failure of other equipment (such as the engine control apparatus B, the fuel injection apparatus C, etc.) and the danger that it may become impossible to halt the engine even if the ignition switch 23 is turned off, due to continuation of inputting energy to the primary winding.

Furthermore, since the energy inputting circuit 6 can be disconnected without disconnecting the circuit path from the battery voltage supply line a to the main ignition circuit 5, the main ignition can be executed when there is a failure of the energy inputting circuit 6.

[Second Embodiment]

Figure 2:
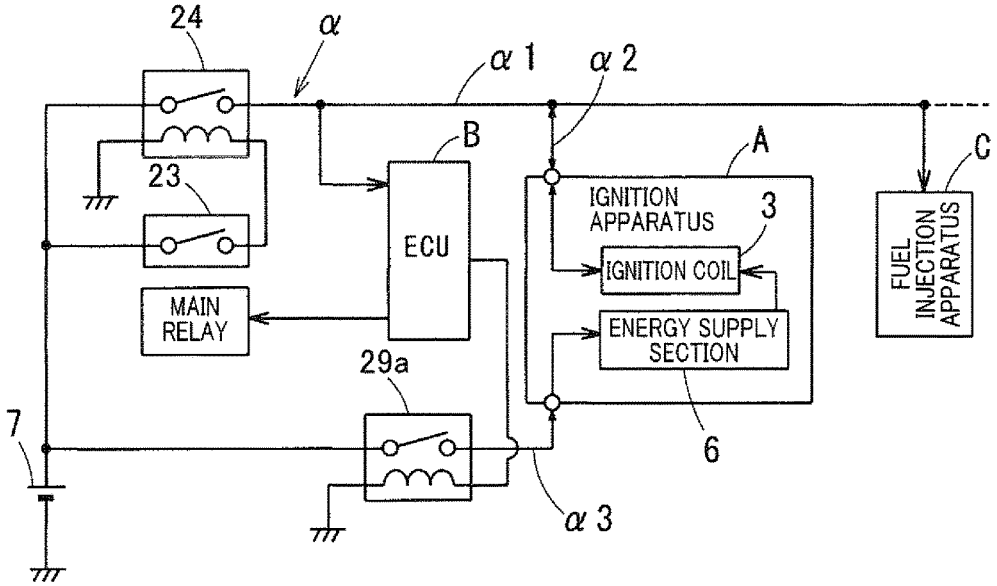
FIG. 2 is a general configuration diagram of an ignition apparatus for an internal combustion engine (second embodiment).

A second embodiment will be described referring to FIGS. 2 and 3.

The ignition apparatus A is applied to a spark ignition engine for running a vehicle, to ignite an air/fuel mixture at predetermined ignition timings within a combustion chamber. The engine as an example is a direct injection type of engine which is capable of lean-burn combustion using gasoline as fuel. The engine incorporates an EGR apparatus which returns a part of the exhaust gas, as EGR gas, to the engine air intake. The engine also includes rotational flow control means which causes rotational flow (tumble flow, swirl flow, etc.) of the air/fuel mixture within each cylinder.

The ignition apparatus A of the second embodiment is a DI (abbreviation for "direct-ignition") type which uses ignition coils 2 corresponding to spark plugs 1 of the respective cylinders.

With this ignition apparatus A, conduction control of a primary winding 3 of an ignition coil 2 is performed based on command signals (an ignition signal IGT and a discharge continuation signal IGW) which are produced from an engine control apparatus (known as an ECU), on which engine control is centered. The ignition apparatus A performs control of the electrical energy produced in a secondary winding 4 of the ignition coil 2, by means of conduction control of the primary winding 3, thereby controlling the spark discharge of the spark plug 1.

An engine control apparatus B generates and outputs the ignition signal IGT and the discharge continuation signal IGW in accordance with engine parameters (warm-up condition, engine rotation speed, engine load, etc.) which are acquired from various sensors, and in accordance with the engine control status (i.e., whether lean-burn combustion operation is being applied, degree of rotational flow, etc.).

The ignition apparatus A installed in the vehicle includes:

spark plugs 1 installed in respective cylinders;

ignition coils 2 installed in respective spark plugs 1;

a main ignition circuit 5 which performs full transistor operation; and an energy inputting circuit 6 which performs spark discharge continuation.

The main parts of the main ignition circuit 5 and the energy inputting circuit 6 are contained together within a case, as the "ignition circuit unit", which is located separately from the spark plugs 1 and the ignition coils 2.

The spark plugs 1 are of known type, each having a central electrode which is connected to one end of the secondary winding 4, and an outer electrode which is connected to ground via the engine cylinder head, etc. Each spark plug 1 generates a spark discharge between the central electrode and the outer electrode by means of a high voltage applied from the secondary winding 4.

The ignition coil 2 is of well-known type, having the primary winding 3 and the secondary winding 4, with the secondary winding 4 having many more winding turns than the primary winding 3.

One end of the primary winding 3 is connected to a battery voltage supply line a, which receives electric power from the positive terminal of a vehicle-installed battery 7.

The other end of the primary winding 3 is connected to ground via an ignition switching means 10 (for example, a power transistor, MOS type transistor, thyristor, etc.) of the main ignition circuit 5.

One end of the secondary winding 4 is connected to the central electrode of the spark plug 1 as described above.

The other end of the secondary winding 4 is connected to ground, or is connected to the battery voltage supply line a. In FIG. 3, the other end of the secondary winding 4 is connected to a first diode 11 which suppresses unnecessary secondary voltages that are produced when current is passed through the primary winding 3, and is connected to ground via the first diode 11 and a current detection resistor 21 which will be described hereinafter.

The main ignition circuit 5 generates the main ignition in the spark plug 1 by control of current passing through the primary winding 3. Specifically, the main ignition circuit 5 serves to set the ignition switching means 10 in the on state during an interval in which the ignition signal IGT is on. When the ignition switching means 10 is turned on, current is passed through the primary winding 3 of the ignition coil 2.

The energy inputting circuit 6 inputs electrical energy from the negative terminal of the primary winding 3 to the battery voltage supply line a, following the main ignition that is produced by the operation of the main ignition circuit 5. The energy inputting circuit 6 thereby continues the passing of secondary current through the secondary winding 4 and continues the spark discharge produced by the operation of the main ignition circuit 5.

Specifically, during a driving condition in which the ignitability is low (during lean-combustion operation, or while strong rotational air currents are produced, or when a high EGR is utilized, or when the engine is being started in a low-temperature condition, etc.), the energy inputting circuit 6 continues spark discharge to thereby increase the ignitability of the air/fuel mixture. The energy inputting circuit 6 includes:

a step-up circuit 12 which steps up the battery voltage;

an energy input capacitor 13 which stores the electrical energy that has been stepped-up in voltage by the step-up circuit 12;

energy input switching means 14 (e.g., a MOS type of transistor, a power transistor, etc.) which turns on/off the energy inputting line β, through which electrical energy is inputted into the primary winding 3 from the energy input capacitor 13;

an energy input drive circuit 15 which turns on/off the energy input switching means 14;

a current detection circuit 22 which performs feedback control of the on/off state of the energy input switching means 14, based on the secondary current; and a second diode 16 which passes current from the energy input capacitor 13 to only the primary winding 3.

The step-up circuit 12 is a chopper type of DC-DC converter which performs DC voltage step-up, and which includes:

a choke coil 17 having one end connected to the battery voltage supply line a, step-up switching means 18 which connects and disconnects current path of the choke coil 17 (e.g., a field effect transistor, a power transistor, etc.), a step-up drive circuit 19 which repeatedly turns on/off the step-up switching means 18, and a third diode 20 which prevents electrical energy stored in the energy input capacitor 13 from flowing back to the choke coil 17.

The step-up drive circuit 19 is provided to cyclically turn on/off the step-up switching means 18, during an interval when the ignition signal IGT supplied.

The current detection circuit 22 performs feedback control of the on/off state of the energy input switching means 14 via the energy input drive circuit 15, such as to maintain the secondary current, monitored using the current detection resistor 21, to be within a target range.

The on/off control of the energy input switching means 14 is not necessarily limited to feedback control, and it would be equally possible to execute on/off control of the energy input switching means 14 by open-loop control, such as to maintain the secondary current within the target range. Furthermore, it would be equally possible for the target value of the secondary current during the interval of the continuation spark discharge to be made constant, or to be varied in accordance with the engine running conditions (indication signals, not shown, provided from the engine control apparatus B).

(Operation Description of the Ignition Apparatus A)

When the ignition signal IGT is changed over from the off to on state, then:

(a) during the interval in which the ignition signal IGT is outputted, the ignition switching means 10 is set to the on state, while concurrently.

(b) during the interval in which the ignition signal IGT is outputted, the step-up switching means 18 is repeatedly turned on/off to perform voltage step-up operation, thereby storing electrical energy in the energy input capacitor 13 at a voltage which is higher than the battery voltage.

(c) When the ignition signal IGT changes from the on to off state, the ignition switching means 10 is turned off, so that the current passing condition of the primary winding 3 is suddenly interrupted. As a result, the flow of primary current is suddenly halted, and concurrently the primary voltage rises. When the secondary voltage thereby rises, thus applying a high voltage to the spark plug 1, the main ignition is produced in the spark plug 1.

(d) After the commencement of main ignition in the spark plug 1, the secondary current attenuates with an approximately triangular waveform. Before the secondary current falls below a predetermined lower limit current (a current that enables the spark discharge to be maintained), the engine control apparatus B outputs the discharge continuation signal IGW.

In response, on/off control of the energy input switching means 14 is then executed by the current detection circuit 22, so that the electrical energy (charge) stored in the energy input capacitor 13 is inputted to the negative end of the primary winding 3. The electrical energy stored in the energy input capacitor 13, at a higher voltage than the battery voltage, thereby flows towards the battery voltage supply line a from the negative end of the primary winding 3.

Specifically, each time the energy input switching means 14 is turned on, electrical energy is supplementarily supplied from the negative end of the primary winding 3 towards the battery voltage supply line a. At each of these flows of electrical energy, a secondary current supplementarily flows in the same direction as the secondary current which flows during main ignition. As a result, such supplemental flows of secondary current through the secondary winding 4 occur successively, following the main ignition.

In that way, by on/off control of the energy input switching means 14, the current detection circuit 22 continuously holds the secondary current at a level which enables the spark discharge to be maintained.

This will be described more specifically. When the spark discharge is caused to waver by strong air currents or the like within the cylinder of the engine, the length of the spark discharge becomes increased and the discharge voltage becomes higher, while the secondary current becomes decreased. When the secondary current falls below a specific value, the energy input switching means 14 is turned on by feedback control of the secondary current, and electrical energy is again inputted to the primary winding 3. As a result, even if the spark discharge is caused to waver due to air currents to increase its length, the secondary current is held substantially constant, the discharge maintaining voltage can be maintained, and extinguishing of the spark discharge can be prevented.

Conversely, if the secondary current tends to increase during the continuation spark discharge, the energy input switching means 14 is turned off by the feedback control of the secondary current, so that the amount of electrical energy inputted into the primary winding 3 becomes decreased. As a result, the secondary current is held substantially constant.

In that way, high ignitability can be achieved while the discharge continuation signal IGW continues, due to the fact that the polarity of the continuation spark discharge remains unchanged. Furthermore, due to the fact that the secondary current is held substantially constant during the continuation spark discharge, electrode wear due to passing high levels of current can be prevented. Moreover, by controlling the secondary current to be substantially constant during the continuation spark discharge, excessive power consumption can be prevented, thereby saving energy.

(f) When the discharge continuation signal IGW changes from the on to the off state, the energy input switching means 14 enters the off state. As a result, the operation of the energy inputting circuit 6 becomes halted, and the continuation spark discharge is terminated.

(Special Technology of the Second Embodiment)

The battery voltage supply line a which is connected to the positive terminal of the vehicle-installed battery 7 includes, in addition to the master power source line α1 which supplies battery voltage to the ignition apparatus A, the engine control apparatus B, the fuel injection apparatus C, etc., an ignition power source line α2 which branches from the master power source line α1 to supply the battery voltage to the primary winding 3, and an energy inputting power source line α3 which branches from the master power source line α1 to supply the battery voltage to the energy inputting circuit 6.

The ignition power source line α2 and the energy inputting power source line α3 are provided independently.

The master power source line α1 is switched on/off by means of the electric power relay 24. The electric power relay 24 is linked to the ignition switch 23, which is operated by the vehicle driver. When the ignition switch 23 is turned on, the battery voltage is supplied to the ignition apparatus A, the engine control apparatus B, the fuel injection apparatus C, etc.

The energy inputting power source line α3 constitutes a power source input section, from which the energy inputting circuit 6 receives the battery voltage. The energy inputting power source line α3 incorporates an energy inputting switch **29*a* (corresponding to the first switch) which switches on/off the energy inputting power source line α3. The energy inputting switch 29*a* supplies and interrupts electric power to the step-up circuit 12. When the energy inputting switch 29*a* is turned off, the voltage step-up operation of the step-up circuit 12 is halted, so that as an effect, the operation of the energy inputting circuit 6** is halted.

The energy inputting switch **29*a* is provided independently of the electric power relay 24, and can operate irrespective of the electric power relay 24**.

As a specific example, the energy inputting switch **29*a* can be a relay switch, which is switched on/off by the engine control apparatus B. The engine control apparatus B is configured such that, when the failure detection signal IGF is received from the abnormality judgement section 28, the energy inputting switch 29*a*** is turned off.

The ignition apparatus A of the second embodiment includes an abnormality judgement section 28, which detects whether or not there is a failure of the energy inputting circuit 6.

It would be possible for the abnormality judgement section 28 to be formed as a part of the engine control apparatus B, or to be formed independently of the engine control apparatus B.

The technology used by the abnormality judgement section 28 for failure judgement of the energy inputting circuit 6 is not limited to the following, in which a specific example is described for ease of understanding.

The abnormality judgement section 28 is configured to receive, as inputs, the monitored value of the secondary current from the current detection circuit 22, and the command values (feedback signal) sent from the current detection circuit 22 to the energy input drive circuit 15. When the commands continuously designate that the inputted electrical energy from the current detection circuit 22 to the energy input drive circuit 15 is to be increased, while the monitored value of the secondary current does not react accordingly, the abnormality judgement section 28 judges that there is a failure of the energy inputting circuit 6.

When the abnormality judgement section 28 judges that there is a failure of the energy inputting circuit 6, the operation of the energy input drive circuit 15 and the step-up drive circuit 19 is forcibly halted, and together with this, the energy inputting switch 29*a* is changed over to the off state. Specifically, when the abnormality judgement section 28 judges that there is a failure of the energy inputting circuit 6, the abnormality judgement section 28 outputs the failure detection signal IGF, thereby turning off the energy inputting switch 29*a*.

Figure 3:
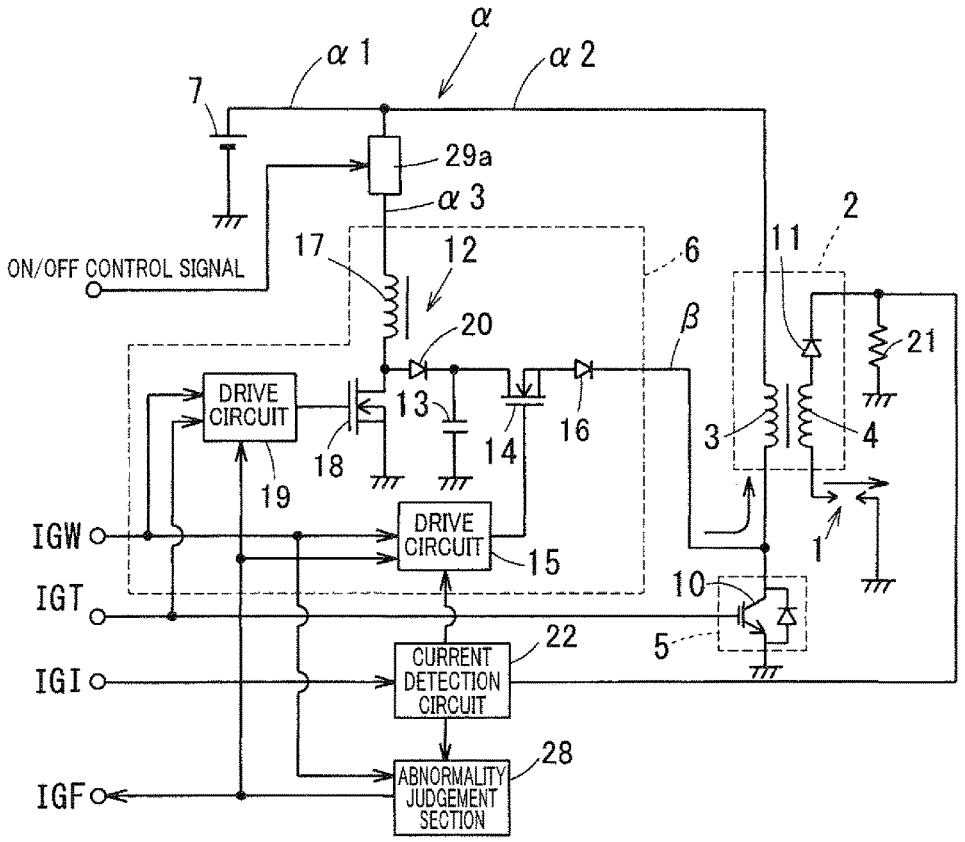
FIG. 3 is a general circuit diagram of an ignition apparatus for an internal combustion engine (second embodiment).

In FIG. 3, the designation IGI signifies a command signal that is sent to the abnormality judgement section 28.

(Advantageous Effects 1 of the Second Embodiment)

With the ignition apparatus A of the second embodiment, as described above, when the abnormality judgement section 28 judges that there is a failure of the energy inputting circuit 6, the energy inputting switch 29*a* is switched off. As a result, the supplying of electric power to the energy inputting circuit 6 is interrupted, so that the inputting of electrical energy via the primary winding 3 and the ignition power source line α2 to the master power source line α1 is halted.

In that way, even if there is a failure of the energy inputting circuit 6, trouble resulting from continuation of inputting electrical energy can be prevented. Hence, the danger of failure of the engine control apparatus B, or the fuel injection apparatus C, etc., due to continuation of inputting electrical energy, can be avoided.

(Advantageous Effects 2 of the Second Embodiment)

With the ignition apparatus A of the second embodiment, as described above, when there is failure of the energy inputting circuit 6, the ignition apparatus A causes the energy inputting switch 29*a* to turn off only the energy inputting power source line α3, without turning off the ignition power source line α2. As a result, even with the energy inputting circuit 6 in a halted condition, the main ignition circuit 5 can be operated. Hence, even in the event of failure of the energy inputting circuit 6, causing the operation of the energy inputting circuit 6 to become halted, running of the engine by means of the main ignition circuit 5 can be continued. That is to say, even in the event of failure of the energy inputting circuit 6, the engine can continue to be run, at least by using the main ignition circuit 5, so that a fail-safe driving mode becomes possible.

It would be equally possible to arrange that, in the event of failure of the energy inputting circuit 6, so that ignition is performed only by the main ignition circuit 5, operation of the engine in a lean-burn mode is halted to thereby render the ignitability (when using only the main ignition circuit 5) more reliable.

[Third Embodiment]

Figure 4:
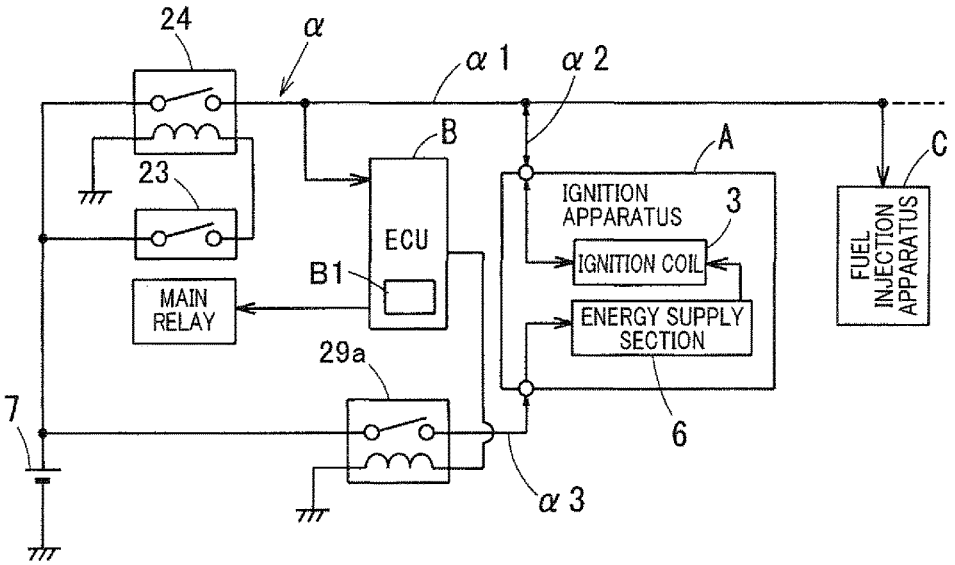
FIG. 4 is a general configuration diagram of an ignition apparatus for an internal combustion engine (third embodiment).

A third embodiment will be described referring to FIGS. 4 and 5. Other than with respect to the following dark current reduction means, the configuration of this embodiment is identical to that of the second embodiment. Items having the same functions as items of the second embodiment are indicated by the same designations as for the second embodiment.

The ignition apparatus A of the third embodiment includes a dark current attenuation means B1. When the engine running state is in the region in which the operation of the energy inputting circuit 6 is halted, the dark current attenuation means B1 changes over the energy inputting switch 29*a* to the off state. The dark current attenuation means B1 is constituted as part of a control program of the engine control apparatus B (but is not limited to this), and acquires the engine running condition based upon engine parameters that are acquired by the engine control apparatus B (in the example of FIG. 5, the engine rotation speed and the air-fuel ratio) and upon the engine control state.

Figure 5:
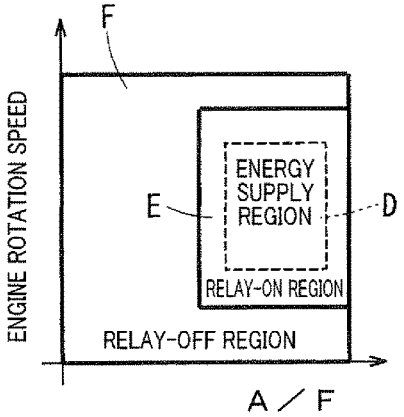
FIG. 5 is a diagram for describing a relationship between engine running conditions and the operation states of an energy input switch (third embodiment).

Specifically, as shown in FIG. 5, with the entire engine running region divided into:

an energy supply region D in which the energy inputting circuit 6 is operated;

a relay-on region E in which the energy inputting switch 29*a* is turned on; and a relay-off region F in which the energy inputting switch 29*a* is turned off, the energy supply region D forms a part of the relay-on region E.

The dark current attenuation means B1 turns off the energy inputting switch 29*a* based on a correspondence relationship between the running condition of the engine and the operation of the energy inputting switch 29*a* as shown in FIG. 5.

(Advantageous Effects of the Third Embodiment)

In that way, by switching the energy inputting switch 29*a* to the off state when the engine is operating in a running region in which the energy inputting circuit 6 is not being operated, wasteful power consumption due to a dark current (a current which flows in the energy inputting circuit 6 when the energy inputting circuit 6 is not being operated) can be suppressed.

[Fourth Embodiment]

A fourth embodiment will be described referring to FIG. 6. Other than with respect to the following dark current attenuation means B1, the configuration of this embodiment is also identical to that of the second embodiment.

The ignition apparatus A of the fourth embodiment includes a dark current attenuation means B1. When the voltage of the vehicle-installed battery 7 falls below a predetermined voltage V1, the dark current attenuation means B1 changes over the energy inputting switch 29*a* to the off state. Similar to the third embodiment, the dark current attenuation means B1 is constituted as part of a control program of the engine control apparatus B (but is not limited to this).

Figure 6:
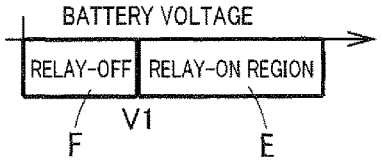
FIG. 6 is a diagram for describing a relationship between battery voltage and the operation states of an energy input switch (fourth embodiment).

That is to say, as shown in FIG. 6:

when the battery voltage is in a region higher than the predetermined voltage V1, operation is in the relay-on region E, and when the battery voltage is in a region lower than the predetermined voltage V1, operation is in the relay-off region F.

(Advantageous Effects of the Fourth Embodiment)

In that way, when the voltage of the vehicle-installed battery 7 is lower than the predetermined voltage V1, the energy inputting switch 29*a* is changed over to the off state. Hence, power consumption of the ignition apparatus A can be reduced when the battery voltage is low.

[Fifth Embodiment]

A fifth embodiment will be described referring to FIG. 7. With the fifth embodiment, items having the same functions as items of the first embodiment are indicated by the same designations as for the first embodiment.

With the fifth embodiment, the connection/disconnection state of the output halt switching means 29 is linked to the ignition switch 23. That is to say, the on/off state of the output halt switching means 29 is linked to the electric power relay 24, which is linked to the ignition switch 23, such that:

(i) when the electric power relay 24 is in the on state, the output halt switching means 29 is accordingly turned on, and (ii) when the electric power relay 24 is in the off state, the output halt switching means 29 is accordingly turned off.

Figure 7:
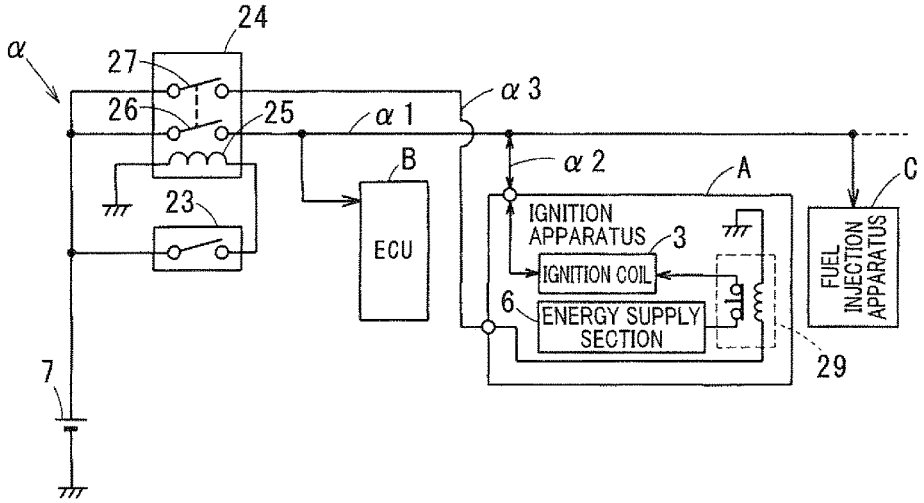
FIG. 7 is a general circuit diagram of ignition apparatus for an internal combustion engine (fifth embodiment).

Specifically, as shown in FIG. 7, the master power source line α1 incorporates the electric power relay 24, which is linked to the ignition switch 23 operated by the vehicle driver. The electric power relay 24 is made up of a relay coil 25 through which current is passed when the ignition switch 23 is turned on, and a master power source switch 26 which is turned on when a current is passed through the relay coil 25.

With this configuration, when the ignition switch 23 is turned on, the master power source switch 26 is thereby turned on, and the battery voltage is supplied to the ignition apparatus A, the engine control apparatus B, the fuel injection apparatus C, etc.

In the fifth embodiment, the energy inputting power source line α3 is branched from the master power source line α1. The energy inputting power source line α3 serves as a power supply line which controls the on/off state of the output halt switching means 29. The energy inputting power source line α3 is switched on/off by means of the auxiliary power source switch 27.

The auxiliary power source switch 27, which operates the output halt switching means 29 as described above, is linked to the operation of the electric power relay 24.

Specifically, when current is passed through the relay coil 25, the master power source switch 26 and the auxiliary power source switch 27 are each turned on, so that the output halt switching means 29 is turned on. When the current flow through the relay coil 25 is halted, the master power source switch 26 and the auxiliary power source switch 27 are each turned off, so that the output halt switching means 29 is turned off.

(Advantageous Effects of the Fifth Embodiment)

As described above, with the ignition apparatus A of the fifth embodiment, when the electric power relay 24 is in the off state, the output halt switching means 29 disconnects the energy inputting line β, so that the inputting of electrical energy from the energy inputting circuit 6 to the primary winding 3 is halted. As a result, even in the event of failure of the energy inputting circuit 6, the inputting of electrical energy to the primary winding 3 is halted when the energy input drive circuit 15 is turned off. Thus, it becomes possible to avoid the danger of stopping the engine, which would otherwise be caused by the continuous inputting of energy to the primary winding 3.

[Sixth Embodiment]

Figure 8:
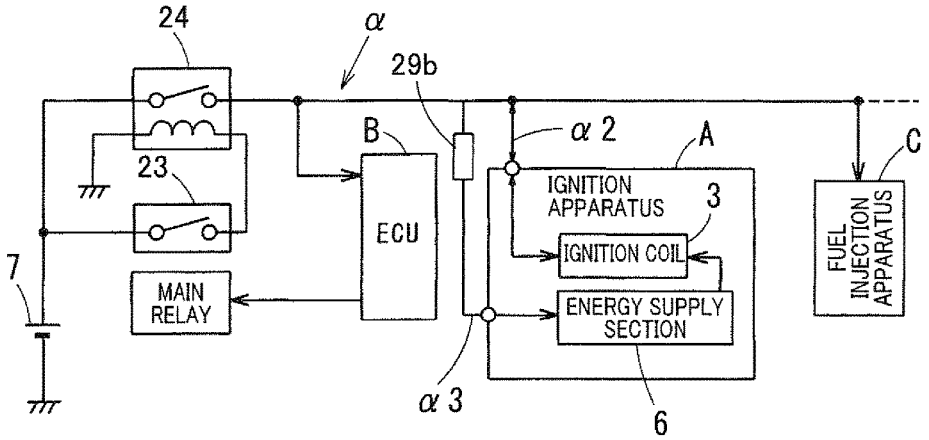
FIG. 8 is a general configuration diagram of an ignition apparatus for an internal combustion engine (sixth embodiment).
Figure 9A:
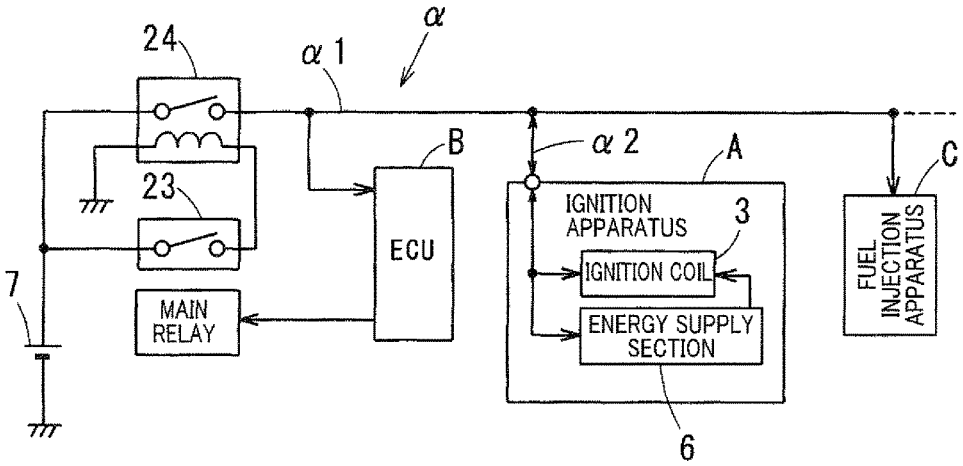
FIG. 9 is a set of diagrams, with (a) showing a general configuration of an ignition apparatus for an internal combustion engine, and with be (b) showing an explanatory view of a flow of inputted electric energy (reference example: technology not publicly known).
Figure 9B:
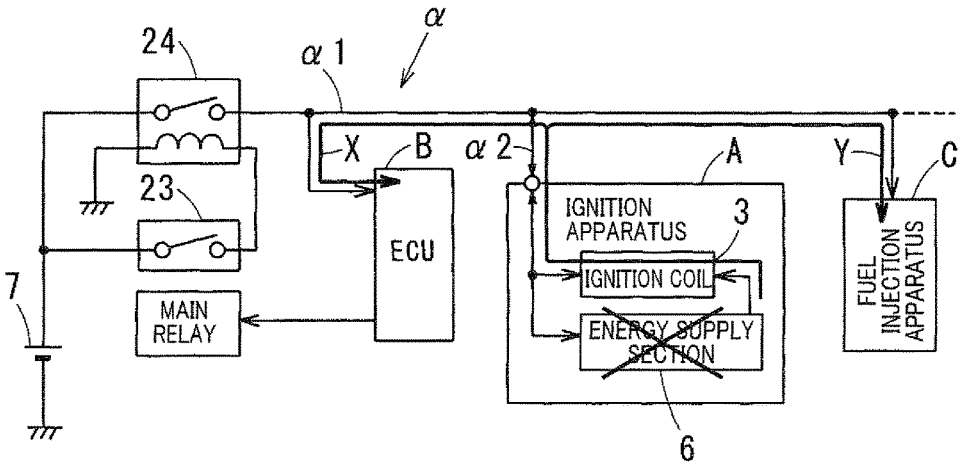

A sixth embodiment will be described referring to FIG. 8. Other than having a fuse 29*b* in place of the energy inputting switch 29*a* and the abnormality judgement section 28 of the second embodiment, the configuration of this embodiment is identical to that of the second embodiment.

The ignition apparatus A of the sixth embodiment is provided with an energy inputting power source line α3 which incorporates the fuse 29*b*. The fuse 29*b* becomes blown, as is well known, if the current passed by it exceeds a predetermined value. When the fuse 29*b* becomes blown, only the energy inputting power source line α3 is switched to a disconnected state. Specifically, the fuse 29*b* is provided such as to become blown when there is a failure of the energy inputting circuit 6 but the energy inputting circuit 6 continues to operate.

(Advantageous Effects of the Sixth Embodiment)

By exchanging the energy inputting switch 29*a* of the second embodiment for the fuse 29*b* of the sixth embodiment, the effects of the second embodiment can be obtained without increase in the cost or increase in size of the ignition apparatus A.

It would also be possible to provide the fuse 29*b* together with the output halt switching means 29, or to provide the fuse 29*b* instead of the output halt switching means 29.

The present invention is not limited in application to the above embodiments.

It would be possible to combine respective embodiments.

With the sixth embodiment described above, the operation of the auxiliary power source switch 27 is linked to that of the electric power relay 24. However, it would be equally possible for the operation of the auxiliary power source switch 27 to be made independent of the electric power relay 24.

The above embodiments have been described by way of examples in which the ignition apparatus A of the present disclosure is used with a gasoline engine. However, it would be equally possible to apply the invention to an engine which uses ethanol fuel or blended fuel, since the ignitability of the air/fuel mixture can be improved by means of the continuation spark discharge. It would of course be equally applicable to improving ignition performance by means of the continuation spark discharge in the case of an engine which may possibly have to utilize a low quality fuel.

The above embodiments have been described by way of examples in which the ignition apparatus A of the present disclosure is used with a lean-burn type of engine, which can operate in a lean-burn combustion mode, to more improve the low ignitability when operating in the lean-burn combustion mode, by means of the continuation spark discharge. However, the continuation spark discharge could be applied for improving ignition even when an engine is operating other than in a lean-burn combustion mode, and so is not limited in application to a lean-burn engine and could be utilized for an engine which does not apply lean-burn operation.

Furthermore, the present disclosure could be equally applied to a high EGR engine (an engine capable of increasing a proportion of exhaust gas that is returned to the engine as EGR gas), for improving ignitability by means of the continuation spark discharge during high EGR operation.

Similarly, the continuation spark discharge could be applied to improving ignitability when the ignitability is low due to operating the engine at low temperature.

The above embodiments show examples which use the ignition apparatus A of the present disclosure for a direct injection type of engine, in which fuel is injected directly into each combustion chamber. However, the present disclosure would be equally applicable to a port injection type of engine, in which the fuel is injected directly towards the upstream of the air intake valve (into the intake port).

The above embodiments have been described by way of examples in which the ignition apparatus A of the present disclosure is applied to an engine in which rotational flow of air/fuel mixture (tumble flow, swirl flow, etc.) is positively generated within the cylinders, with the continuation spark discharge being used to prevent "extinguishing of the spark discharge by the rotational flow". However, the ignition apparatus A would be equally applicable to an engine which does not use rotational flow control means (tumble flow control valve, swirl flow control valve, etc.).

In the above embodiments, the present disclosure has been applied to a DI type of ignition apparatus A. However, the present disclosure is not limited to a DI type, and could equally be applied, for example, to an ignition apparatus A of a single-cylinder engine (e.g., of a two-wheel motor vehicle).

With the above embodiments, a full transistor type of circuit has been used as an example of the main ignition circuit 5, but the present disclosure is not limited to this form of the main ignition circuit 5. That is, the main ignition circuit 5 only needs to cause the main ignition by control of the conduction condition of the primary winding 3, and thus the main ignition circuit 5 may be other main ignition circuit than a full transistor circuit such as a CDI ignition circuit, etc.

DESCRIPTION OF REFERENCE SIGNS

1 spark plug
2 ignition coil
3 primary winding
4 secondary winding
5 main ignition circuit
6 energy inputting circuit
28 abnormality judgement section
29 halt switching means

What is claimed is:

1. An ignition apparatus for an internal combustion engine, wherein the ignition apparatus comprises:

a main ignition circuit which generates a spark discharge in a spark plug by control of passing current through a primary winding of an ignition coil;

an energy inputting circuit which, during the spark discharge produced by operation of the main ignition circuit, inputs electrical energy from a negative end of the primary winding towards a supply side of a battery voltage, thereby continuing the spark discharge that is generated by operation of the main ignition circuit;

a first switch which performs switching between connected and disconnected states of an energy inputting line or an energy inputting power source line, so that the energy inputting circuit is connected to or disconnected from a current flow path that extends from a battery supplying the battery voltage to the main ignition circuit, where the energy inputting line inputs electrical energy from the energy inputting circuit towards the primary winding and the energy inputting power source line supplies electric power to the energy inputting circuit; and an abnormality judgement section which changes over the first switch to a disconnected state when a failure is detected in the energy inputting circuit, wherein:

the energy inputting power source line is provided separately from an ignition power source line which supplies the battery voltage to the primary winding;

the first switch serves to switch the energy inputting power source line between connected and disconnected states; and when a failure of the energy inputting circuit is detected, the abnormality judgement section changes over the first switch to a disconnected state, thereby disconnecting the energy inputting power source line without disconnecting the ignition power source line.

2. The ignition apparatus for an internal combustion engine according to claim 1, wherein, when a running condition of the engine is in an operation-halted region of the energy inputting circuit, the first switch is changed over to a disconnected state.

3. The ignition apparatus for an internal combustion engine according to claim 1, wherein:

the battery supplies electric power to the ignition apparatus; and when a voltage of the battery falls below a predetermined voltage, the first switch is changed over to a disconnected state.

4. The ignition apparatus for an internal combustion engine according to claim 1, wherein:

the first switch is provided in the energy inputting line or in the energy inputting power source line; and the first switch serves as a circuit disconnecting means which changes over only the energy inputting line or the energy inputting power source line to a disconnected state, when a flow of current exceeds a predetermined value of current.

5. The ignition apparatus for an internal combustion engine according to claim 4, wherein the circuit disconnecting means serves as a fuse which becomes blown when a flow of current exceeds a predetermined value of current.

6. The Ignition apparatus for an internal combustion engine according to claim 1, wherein:

an electric power relay is linked to an ignition switch that is operated by a vehicle driver;

when the electric power relay is in an on state, the first switch is turned on; and when the electric power relay is in an off state, the first switch is turned off.

7. The ignition apparatus for an internal combustion engine according to claim 1, wherein the first switch is changed over to the disconnected state based on a correspondence relationship between a running condition of the engine and an operation of the first switch.

8. The ignition apparatus for an internal combustion engine according to claim 7, wherein the running condition of the engine is acquired from an engine control apparatus, the running condition is an engine parameter and/or an engine control state.

* * * * *